US011473038B2

(12) United States Patent
Bortolai et al.

(10) Patent No.: US 11,473,038 B2
(45) Date of Patent: Oct. 18, 2022

(54) HIGH WATER HARD BARS COMPRISING COMBINATION OF TYPE AND AMOUNT OF ELECTROLYTES

(71) Applicant: Conopco, Inc., Englewood Cliffs, NJ (US)

(72) Inventors: Gislene Splendore Bortolai, São Paulo (BR); Sergio Roberto Leopoldino, São Paulo (BR); Enio Mitsuki Oura, Sào Paulo (BR); Yuriy Konstantinovich Yarovoy, Monroe, CT (US); Rodrigo Alves De Mattos, Sao Paulo (BR)

(73) Assignee: CONOPCO, INC., Englewood Cliffs, NJ (US)

( * ) Notice: Subject to any disclaimer, the term of this patent is extended or adjusted under 35 U.S.C. 154(b) by 0 days.

(21) Appl. No.: 17/425,357

(22) PCT Filed: Feb. 10, 2020

(86) PCT No.: PCT/EP2020/053338
§ 371 (c)(1),
(2) Date: Jul. 23, 2021

(87) PCT Pub. No.: WO2020/169392
PCT Pub. Date: Aug. 27, 2020

(65) Prior Publication Data

US 2022/0081655 A1 Mar. 17, 2022

(30) Foreign Application Priority Data

Feb. 19, 2019 (EP) ..... 19157894

(51) Int. Cl.
*C11D 9/02* (2006.01)
*C11D 9/12* (2006.01)
*C11D 9/22* (2006.01)
*C11D 13/18* (2006.01)

(52) U.S. Cl.
CPC ..... *C11D 9/02* (2013.01); *C11D 9/12* (2013.01); *C11D 9/225* (2013.01); *C11D 13/18* (2013.01)

(58) Field of Classification Search
CPC .. C11D 9/02; C11D 9/12; C11D 9/225; C11D 13/18
See application file for complete search history.

(56) References Cited

U.S. PATENT DOCUMENTS 2,686,761 A 8/1954 Ferguson et al.
2,798,053 A 7/1957 Brown
4,297,230 A 10/1981 Rasser
4,678,593 A 7/1987 Ridley
4,891,149 A 1/1990 Nagarajan et al.
4,969,925 A 11/1990 Sisco et al.
5,194,172 A 3/1993 Taneri et al.
5,225,097 A 7/1993 Kacher et al.
5,264,144 A 11/1993 Moroney et al.
5,425,892 A 6/1995 Taneri et al.
5,703,026 A 12/1997 Setser et al.
5,952,289 A 9/1999 Wise et al.
(Continued)

FOREIGN PATENT DOCUMENTS

EP 0014502 8/1980
GB 1333042 10/1973
(Continued)

OTHER PUBLICATIONS

Search Report and Written Opinion in EP19157897; dated Sep. 3, 2019; European Patent Office (EPO).
Search Report and Written Opinion in EP19157900; dated Sep. 3, 2019; European Patent Office (EPO).
Search Report and Written Opinion in EP19157894; dated Sep. 2, 2019; European Patent Office (EPO).
Search Report and Written Opinion in PCTEP2020051915; dated Apr. 22, 2020; World Intellectual Property Org. (WIPO).
Search Report and Written Opinion in PCTEP2020053443; dated Apr. 22, 2020; World Intellectual Property Org. (WIPO).
Written Opinion 2 in PCTEP2020053338; dated Feb. 5, 2021; World Intellectual Property Org. (WIPO).
(Continued)

*Primary Examiner* — Deborah D Carr
(74) *Attorney, Agent, or Firm* — Krista A. Kostiew

(57) ABSTRACT

The invention relates to a process to make high water bars with a high speed extrusion process by using specific types and amounts of electrolytes in combination. The bars are produced with no negatives generally associated with use of electrolytes. Disclosed is an extruded soap bar composition wherein the bar comprises: a) 20 to 40% of water; b) 20 to 75% by wt. anhydrous soap; wherein $C_{16}$ to $C_{24}$ saturated soap comprises 12% to 45% by wt. of total bar. c) structurants comprises at least from 0.05 to 35% by wt., wherein the specific level of structurants is defined by the level of C16 to C24 saturated soap of (b) such that the total level of said $C_{16}$ to $C_{24}$ saturated soap and structurants are greater than 25%, and wherein said structurants are selected from the group consisting of starch, carboxymethylcellulose, inorganic particulates, acrylate polymers and mixtures thereof; d) electrolyte which is a combination of alkali metal chloride; and a secondary electrolytes selected from the group consisting of alkali metal citrate and alkali metal sulfate; and wherein the concentration of alkali metal chloride ([alkali metal chloride]); and of alkali metal citrate ([alkali metal citrate]), alkali metal sulfate ([alkali metal sulfate]) defined by level of water we use as follows: i. [alkali metal chloride]%=0.075×[water]−0.626; and ii. [alkali metal citrate]%=−0.0023×[water]$^2$+0.312×[water]−4.34; iii. [alkali metal sulfate]%=−0.0023×[water]$^2$+0.312×[water]−4.34; or iv. [alkali metal citrate and alkali metal sulfate]=−0.0023×[water]$^2$+0.312×[water]−4.34, wherein the calculated amount of the concentration of the electrolyte is plus or minus 15%.

10 Claims, No Drawings

(56) References Cited

U.S. PATENT DOCUMENTS

| | | | |
|---|---|---|---|
| 6,143,704 | A | 11/2000 | Van Gunst et al. |
| 2002/0016271 | A1 | 2/2002 | Racherla |
| 2002/0155982 | A1 | 10/2002 | Bauer et al. |
| 2004/0157756 | A1 | 8/2004 | Kuroda |
| 2009/0143267 | A1 | 6/2009 | Zhang et al. |
| 2009/0286706 | A1 | 11/2009 | Chakrabarty et al. |
| 2012/0058164 | A1 | 3/2012 | Merchant et al. |
| 2014/0053508 | A1 | 2/2014 | Chourey et al. |
| 2014/0378363 | A1 | 12/2014 | Thiessies et al. |

FOREIGN PATENT DOCUMENTS

| | | |
|---|---|---|
| GB | 2231882 | 11/1990 |
| GB | 2238316 | 5/1991 |
| GB | 2459093 | 10/2009 |
| IN | 286834 | 2/2012 |
| JP | 2004256805 | 9/2004 |
| WO | WO9732965 | 9/1997 |
| WO | WO0246341 | 6/2002 |
| WO | WO2004000988 | 12/2003 |
| WO | WO2006053708 | 5/2006 |
| WO | WO2006097238 | 9/2006 |
| WO | WO2008071561 | 6/2008 |
| WO | WO2010089269 | 8/2010 |
| WO | WO2010140380 | 12/2010 |
| WO | WO2017016803 | 2/2017 |
| WO | WO2017016807 | 2/2017 |
| WO | WO2017202577 | 11/2017 |
| WO | WO2020169306 | 8/2020 |
| WO | WO2020169409 | 8/2020 |

OTHER PUBLICATIONS

IPRP2 in PCTEP2020051915; dated Jun. 11, 2021; World Intellectual Property Org. (WIPO).

IPRP2 in PCTEP2020053338; dated Apr. 5, 2021; World Intellectual Property Org. (WIPO).

Search Report and Written Opinion in PCTEP2020053338; dated Apr. 21, 2020; World Intellectual Property Org. (WIPO).

Mineral Body Bar; Zeosoft; 2019; pp. 1-2; https://zeosoft.co.nz/product/mineral-body-bar/; New Zealand.

HIGH WATER HARD BARS COMPRISING COMBINATION OF TYPE AND AMOUNT OF ELECTROLYTES

CROSS REFERENCE TO RELATED APPLICATIONS

The present application is a U.S. National Phase Application under 35 U.S.C. § 371 of International Application No. PCT/EP2020/053338, filed on Feb. 10, 2020, which claims priority to European Patent Application No. 19157894.7, filed on Feb. 19, 2019, the contents of which are incorporated herein in their entireties.

FIELD OF THE INVENTION

The invention relates to fatty acid soap bars made by a rapid extrusion process where typically greater than 200 bars/minute are extruded and stamped. More particularly, it relates to such bars comprising a combination of specific types and amounts of electrolyte such that the water level can be significantly increased to 20% to 40%, by wt. without compromising on speed of bar production while simultaneously maintaining excellent bar properties (low or no cracking; no efflorescence) typically associated with use of electrolytes.

BACKGROUND OF THE INVENTION

The present invention relates to bars which are made by a high-speed extrusion process, which we define herein to mean bars which can be extruded, cut and stamped at a rate of 200 or more bars per minute. The bars are predominantly fatty acid soap bars where the soaps are present in higher than 50%, preferably higher than 75% or 80 or 90% or up to 100% of the surfactants used in the bar. The bars comprise fatty acid soap in amount of less than 75%, or 70% or 65% or 60%, preferably 55% or less to 20% by wt. depending on level of water and other components.

Because it has been demonstrated that the soap bars comprise more active soap than needed to show cleansing or surfactant properties, much of the sodium soaps used are there only to structure the bar. Thus, it is possible to replace the soaps with solvent (e.g. glycerine and water) or particulates without compromising on cleansing. This can also reduce the costs of the bar and could also bring additional benefits for consumers, such as mildness.

However, increasing water level also makes the bar softer and more tacky (meaning slightly sticky). The softer and/or stickier bar causes problems in bar extrusion and stamping and reduces the speed of bar production.

To counter the effect of increased water levels, it is also possible to add electrolytes to soap. The electrolyte serves to "shorten" the soap by which is meant that the soap bar increases in hardness and becomes less sticky. However, the addition of electrolytes provides its own set of negative attributes; for example, it leads to greater degree of cracking or fissures in the extruded bars (to a level unacceptable by consumer); and further can lead to formation of an electrolyte layer on the bar surface which is visible to the naked eye, a phenomenon referred to as "efflorescence".

It is thus extremely difficult to provide predominantly fatty acid soap surfactant based bars which have high levels of water, which can be extruded at speed of 200 bars per minute and higher; and which do not simultaneously suffer from the problem of undesirable cracking and/or efflorescence (electrolyte formation) during bar storage.

Unexpectedly, applicants have now found that, through a specific combination of specific types of electrolytes and strictly controlled amounts of the specific electrolytes, it is possible to provide high extrusion, high water bars while avoiding the problems of bar cracking and bar efflorescence, particularly when storing.

The use of electrolyte salts such as alkali metal chloride (e.g., sodium chloride) and alkali metal citrate or alkali metal sulfate (e.g., sodium citrate or sodium sulfate), for example, in fatty acid soap bars, broadly speaking, is not new. The salts promote a so-called "salting out" effect and help to harden the bars. As indicated above, however, the salts also can lead to excessive cracking and efflorescence. As such, applicants are unaware of any teaching where these salts are used to enhance water levels of bars (causing softness and tackiness) by hardening with these electrolytes since it will simultaneously lead to the negative effects noted (excessive cracking, efflorescence).

U.S. Pat. No. 6,143,704 to Van Gunst, for example, discloses bars comprising 50 to 80% soaps using minimal levels (4 to 35% by wt.) of free fatty acid in place of synthetic surfactants to provide mildness. Because fatty acid can lead to poor user profiles, organic salts (e.g., sodium citrate) are used at levels of 1 to 10% by wt. to alleviate this problem. Exemplified water levels are about 10% so it is clear that the salts are not used to help enhance such water levels.

U.S. Pat. No. 4,297,230 to Rasser discloses bars which have equal or greater than 60% soap; electrolyte (which may include sodium citrate) at a level of 0.2 to 5.0% by wt.; and 4 to 25% water. Electrolyte is said to be used to help overcome the problem of crystal formation. Water levels, as noted, can be up to 25%, but there is no disclosure of use of specific types and amounts of electrolyte, in combination, to enhance the amount of water used while extruding efficiently and avoiding efflorescence. Compositions of our invention can use far greater amounts of water and less soap, while avoiding the problem of excessive cracking and efflorescence when going into these higher water ranges.

If specific examples of Rasser (which do not have our combination of chloride and citrate, for example), used more water, examples of our invention (e.g., comparative C) demonstrate they would have problems of cracking or excessive softness.

WO 2017/016803 to Agarkhed discloses compositions which may have 10 to 30% soap; 20 to 45% soluble organic solvent; 20 to 40% water; 3 to 20% electrolyte (other than soap); and benefit agent (see claim 11). In these compositions, the level of soap relative to the level of polyol plus water is important and, in the examples at Table 1, it can be seen that this ratio is below 1, in fact below 0.5. In compositions of our invention, while the levels of water can be high, the ratio of soap to polyol plus water is preferably much higher. It preferably is 0.5:1 or greater, preferably 1:1 or greater, e.g., up to 5:1. This is preferably required for extruded bars of our invention compared to cast melt bars of Agarkhed. It is noted that when structuring agents are used in bars, the ratio of soap to polyol plus water can be on the lower end (0.5:1 or 1:1) rather than 5:1 or 4:1.

WO 2017/016807 to Agarkhed has claim similar to 2017/016803 except that it does not comprise a benefit agent. Again, the ratio of soap to polyol plus water is very low, below 0.5:1. This is possible only because these bars are cast melt bars.

SUMMARY OF THE INVENTION

According to the present invention, applicants can manufacture high water, extruded fatty acid soap bars at high speed (200 or greater, in some embodiments greater than 200 bars per minute) while maintaining excellent user properties (no excessive cracking or efflorescence). This is accomplished by using a very specific combinations of electrolyte salts in very specific amounts which affects the so-called "bricks and mortar" structure of the bar in surprising ways. More specifically, more water can be introduced (which typically increases the amount of soluble soaps found in the "mortar" and results in softer, tackier bars which are more difficult to extrude), but the specific combination and amounts of electrolyte salt (salt electrolyte normally hardens bar, but causes cracking etc.) changes the mortar phase in a way that the bar continues to extrude well, yet avoids negatives, including cracking and efflorescence issues.

More specifically, the invention comprises an extruded bar with high water levels which processes at 200 bars or more per minute while maintaining a minimal defined hardness, a low stickiness and low cracking scores (all measured per defined protocol) wherein the bar comprises:

a) 20 to 40% of water, preferably 25 to 40% by wt., more specifically lower level of 26% or 27% or 28% or 29% or 30% and upper level of 39% or 38% or 37% or 36% or 35% by wt. of bar wherein any lower level can be used interchangeably with any upper level;

b) 20 to 75%, preferably 25 or 30 or 31 or 32 or 35 or 40% on lower level to 70% or 65% by wt. on upper level anhydrous soap; wherein 12 to 45% by wt. of total bar comprises $C_{16}$ to $C_{24}$ saturated soap c) structurants at level from 0.05 to 35% (preferably 35 or 30 or 25%) by wt., wherein the specific level of structurants is defined by the level of $C_{16}$ to $C_{24}$ saturated soap, such that the total level of said $C_{16}$ to $C_{24}$ saturated soap and the additional structurants is greater than 25%. Said structurants include, structurants selected from the group consisting of starch, carboxymethylcellulose, inorganic particulates (for example, talc, calcium carbonate, zeolite), acrylate polymers and mixtures thereof;

d) electrolyte which is a combination of alkali metal chloride; and a secondary electrolyte selected from the group consisting of alkali metal citrate and alkali metal sulfate and mixtures thereof; and wherein the concentration of alkali metal chloride ([alkali metal chloride]) and of alkali metal citrate ([alkali metal citrate]) or alkali metal sulfate ([alkali metal sulfate]) are defined by level of water ([water]) we use (e.g., 20-40%) as follows:

1. [alkali metal chloride]%=0.075×[water]−0.626; and
2. [alkali metal citrate]%=−0.0023×[water]$^2$+0.312×[water]−4.34; [alkali metal sulfate]%=−0.0023×[water]$^2$+0.312×[water]−4.34; or [alkali metal citrate plus alkali metal sulfate]%=−0.0023×[water]$^2$+0.312×[water]−4.34 (specifically, Item (2) defines citrate, sulfate or mixtures of citrate and sulfate).

It is noted that the calculated amount of the concentration of the electrolyte is plus or minus 15% (e.g., if the calculated concentration of sodium chloride is 0.86 based on the formula, it may be used at level of 0.86±0.129% by wt. The calculated amount of the concentration of the electrolyte is preferably plus or minus 10%, further more preferably plus or minus 5%.

In addition, the ratio of [soap] to [water plus any water-soluble solvent] which may be present (polyol such as glycerine or sorbitol) is in a ratio of 0.5:1 to 5:1, preferably 1:1 to 3:1. Since it is typically preferred to have less soap and more water, ratios on the lower end (1:1 to 2:1) are particularly preferred. For example, in our examples, 35% water bar has ratio of soap to water plus glycerine of 1.31, while bar with 20% water has ratio of 2.6:1. The bar with ratio between 1:1 and 2:1 (35% water) is preferred when desiring to replace as much soap as possible with water. Also, as noted, when larger amounts of bar structurants are used (structurants may be present at levels ranging from 0.05 to 35% by wt.), the ratio of [soap] to [water plus water-soluble solvent] may be closer to 0.5:1 or 1:1 than higher ratios of 3:1 to 5:1.

Preferably the combination of level of $C_{16}$ to $C_{24}$ saturated soap plus other bar structurants (defined below) is greater than 25% by wt. of bar.

The resulting bars have hardness (as defined in the protocol) of 1.2 Kg and greater; stickiness score (as defined) of less than 3; and cracking score (as defined) of 3 or less on scale of 1 to 5.

DETAILED DESCRIPTION OF THE INVENTION

Except in the examples, or where otherwise explicitly indicated, all numbers in this description indicating amounts of material or conditions of reaction, physical properties of materials and/or use are to be understood as modified by the word "about."

As used throughout, ranges are used as shorthand for describing each and every value that is within the range. Any value within the range can be selected as terminus of the range. The use of "and/or" indicates that any one from the list can be chosen individually, or any combination from the list can be chosen.

For the avoidance of doubt, the word "comprising" is intended to mean "including" but not necessarily "consisting of" or "composed of." In other words, the listed steps or options need not be exhaustive.

Unless indicated otherwise, all percentages for amount or amounts of ingredients used are to be understood to be percentages by weight based on the active weight of the material in the total weight of the composition, which total is 100%.

Various compounds of the invention are described in greater detail below.

Fatty Acid Soap

The anhydrous soaps of the invention are present at a level of 20 to 75%, preferably 30 to 65% by weight of the bar. The term soap herein means salts of fatty acids. Preferably, the soap is a soap of $C_8$ to $C_{24}$ fatty acids, more preferably of $C_8$ to $C_{18}$ fatty acids. The $C_8$ to $C_{14}$ soaps (especially $C_{12}$) are typically short chain soluble soaps while $C_{16}$ to $C_{24}$ are longer chain less-soluble soaps. The unsaturated $C_{18}$ soap (e.g., oleate) are typically more soluble like the short chain soluble soaps.

In conventional extruded soap, a mixture of two separate crystal types form at thermodynamic equilibrium. One crystal type, referred to as delta phase, is composed of the less soluble saturated long-chain soaps (e.g., $C_{16}$ and $C_{18}$ soaps) and is dispersed in a continuum of another crystal type composed of the more soluble saturated short-chain soaps and unsaturated soaps (e.g., $C_{12}$ and $C_{18:1}$ soaps), referred to as eta phase. The configuration of less soluble soaps dispersed in a continuum of more soluble soaps can be compared to "bricks and mortar" structure. The continuous phase (the "mortar"), which is composed of the more soluble soaps, will also contain more water than the dispersed phase (the "bricks"), which is composed of the less soluble soaps.

For the purpose of the present invention, "insoluble soap" refer to monovalent salts of saturated fatty monocarboxylic acids having a carbon chain length of 16 to 24, preferably $C_{18}$ to $C_{22}$ or $C_{16}$ to $C_{18}$. "Soluble" soap on the other hand refers to monovalent salts of saturated fatty monocarboxylic acids having a carbon chain length of 8 to 14 and monovalent salts of oleic acid and polyunsaturated fatty monocarboxylic acids having a carbon chain length of 8 to 24.

According to our invention $C_{18}$ to $C_{24}$ soaps comprise 12 to 45% by wt. of total bar.

Preferably short chain $C_8$ to $C_{14}$ comprises 2 to 20% by wt. of total bar. Also preferably unsaturated $C_{18}$ fatty acid having, one, two or three unsaturated groups in the $C_{18}$ chain comprises 6% to 35%, more preferably 12 to 35% by wt. of total bar.

In addition to the long, saturated soaps which act as structurants ("bricks"), bars of the invention comprise 0.05 to 35% structurants. Use of more structurants permits lower ratio of [soap] to [water soluble solvent e.g. polyol plus water] if desired.

The structurant may include structurants such as starches, sodium carboxymethylcellulose, inorganic particulate matter (e.g., talc, calcium carbonate, zeolite and mixtures of such particulates) acrylate polymers, and mixtures thereof. The combined level of $C_{18}$ to $C_{24}$ long chain structurants and structurants noted above should be greater than 25%, preferably, 25% to 40%.

Because of the high levels of water used in the bars of the invention (20% to 40%, preferably 25% to 40% by wt., preferably 26% or 27% or 28% or 29% or 30% by wt. as lower limit and 39 or 38 or 37 or 36 or 35% as upper limit, where any lower limit can be used interchangeably with any upper limit) in bars previously known in the art, the level of water (in the previous bars) typically results in bars which are soft and tacky (compared to bars of our invention which are defined by minimal hardness and low stickiness score). Such bars have difficulty extruding and stamping at a high extrusion rate of 200 bars per minute and greater.

While electrolyte salts are known to harden bars, they typically result in extruded bars which are so hard and brittle they have excessive cracking (4 or 5 on test described below) and/or provide efflorescence (layer of electrolyte) on the bar surface, particularly on storage.

Applicants have found a process to ensure that, when specific types and amounts of electrolyte are used, bars can be extruded and stamped at high rate while avoiding excessive cracking and efflorescence. The bars have defined minimal hardness and low stickiness scores. Both the process for adding the appropriate type and amount of electrolyte and the resulting bars are claimed.

Specifically, the electrolyte must be a specific combination of alkali metal chloride (in defined amounts) together with secondary electrolyte which can be alkali metal citrate, alkali metal sulfate, or mixtures of the citrate and sulfate, wherein the secondary electrolyte(s) is also used in specific defined amounts whether alone or as a mixture. The alkali metal may be sodium or potassium preferably sodium.

The amount of electrolyte providing this benefit is defined as follows:

1. [alkali metal chloride] %=$\mathbf{0.075}\times$[water]−0.626; and
2. [alkali metal citrate] %=$\mathbf{-0.0023}\times[\text{water}]^2+0.312\times$[water]−4.34; [alkali metal sulfate] %=$\mathbf{-0.0023}\times[\text{water}]^2+0.312\times$[water]−4.34; or [alkali metal citrate plus alkali metal sulfate] %=$\mathbf{-0.0023}\times[\text{water}]^2+0.312\times$[water]−4.34, wherein the calculated amount of the concentration of the electrolyte is plus or minus 15% (e.g., if calculated concentration of sodium chloride is 0.86 based on the formula, it may be based at level of 0.86±0.129% by wt.

Based on the above formula, developed with extensive experimentation by the inventors involving hundreds of bars produced with various compositions, the preferred amounts of electrolytes for various preferred range of water is summarised below:

Water from 20 to 40 wt % of the Bar:

Sodium chloride could be included in the range of 0.74 to 2.73%, preferably 0.79 to 2.61%, most preferably 0.83 to 2.49% by weight of the bar.

Sodium sulphate or sodium citrate or a combination of the two could be included in 0.83 to 5.13%, preferably 0.88 to 4.91%, most preferably 0.93 to 4.68% by weight of the bar.

Water from 20 to 35 wt % of the Bar:

Sodium chloride could be included in the range of 0.74 to 2.30%, preferably 0.79 to 2.20%, most preferably 0.83 to 2.10% by weight of the bar.

Sodium sulphate or sodium citrate or a combination of the two could be included in 0.83 to 4.33%, preferably 0.88 to 4.14%, most preferably 0.93 to 3.95% by weight of the bar.

Water from 25 to 35 wt % of the Bar:

Sodium chloride could be included in the range of 1.06 to 2.30%, preferably 1.12 to 2.20%, most preferably 1.19 to 2.10% by weight of the bar.

Sodium sulphate or sodium citrate or a combination of the two could be included in 1.72 to 4.33%, preferably 1.82 to 4.14%, most preferably 1.92 to 3.95% by weight of the bar.

Also, the ratio of [soap] to [water and any water soluble solvent e.g., glycerine or sorbitol] is 0.5:1 or greater, preferably 1:1 to 5:1, more preferably 1.2:1 to 3:1, even more preferably 1.2:1 to 2:1.

Using such defined components (electrolyte amounts; ratio of soap to water and optional solvent), we obtain bars which are extruded at 200 or more bars/minute and have hardness value of 1.2 Kg to 5.0 Kg (measured at 40° C.); stickiness of less than 3, preferably 0 to 2; and cracking score of 3 or less, and which bars are free of visible efflorescence.

Other Ingredients

In addition to the soap of fatty acids, preferred bars may include a non-soap surfactant, which acts as a co-surfactant and which is selected from anionic, non-ionic, zwitterionic, amphoteric and cationic surfactants. Preferred bars include 0.0001 to 15 wt. % co-surfactants based on the weight of the composition. More preferred bars include 2 to 10 wt. % co-surfactant and most preferred compositions include 2.5 to 6 wt. % co-surfactant based on the weight of the composition.

Suitable anionic surfactants include water soluble salts of organic sulphuric reaction products having in the molecular structure an alkyl radical containing from 8 to 22 carbon atoms, and a radical chosen from sulphonic acid or sulphuric acid ester radicals, and mixtures thereof.

Preferred water-soluble synthetic anionic surfactants are the alkali metal (such as sodium and potassium) and alkaline earth metal (such as calcium and magnesium) salts of higher alkyl benzene sulphonates and mixtures with olefin sulphonates and higher alkyl sulphates, and the higher fatty acid monoglyceride sulphates.

Suitable nonionic surfactants can be broadly described as compounds produced by the condensation of alkylene oxide groups, which are hydrophilic in nature, with an organic hydrophobic compound which may be aliphatic or alkyl aromatic nature.

Suitable cationic surfactants that can be incorporated are alkyl substituted quaternary ammonium halide salts, e.g., bis (hydrogenated tallow) dimethylammonium chlorides, cetyltrimethyl ammonium bromide, benzalkonium chloride and amine and imidazoline salts for, e.g., primary, secondary and tertiary amine hydrochlorides and imidazoline hydrochlorides.

Suitable amphoteric surfactants are derivatives of aliphatic secondary and tertiary amines containing an alkyl group of 8 to 18 carbon atoms and an aliphatic radical substituted by an anionic water-solubilizing group, for instance sodium 3-dodecylamino-propionate, sodium 3-dodecylaminopropane sulphonate and sodium N-2-hydroxydodecyl-N-methyltaurate.

Suitable zwitterionic surfactants are derivatives of aliphatic quaternary ammonium, sulphonium and phosphonium compounds having an aliphatic radical of from 8 to 18 carbon atoms and an aliphatic radical substituted by an anionic water-solubilizing group, for instance 3-(N—N-dimethyl-N-hexadecylammonium) propane-1-sulphonate betaine, 3-(dodecylmethyl sulphonium) propane-1-sulphonate betaine and 3-(cetylmethylphosphonium) ethane sulphonate betaine.

Further examples of suitable detergent-active compounds are compounds commonly used as surface-active agents given in the well-known textbooks "Surface Active Agents", Volume I by Schwartz and Perry and "Surface Active Agents and Detergents", Volume II by Schwartz, Perry and Berch.

Bars may comprise water soluble organic solvents which can be selected from the group consisting of polyols, hydrotropes and mixtures. The amount of solvent may be in the range of 0 to 12%.

A particularly preferred polyol is glycerol. Generally, there are no other solvents in extruded bars. A preferred level of glycerol can also be measured based on starting amount of water as per the following formula:

$$[\text{Glycerol}]\% = \mathbf{0.34} \times [\text{water}] - 1.78$$

For example, if water is as high as 40%, glycerol can be used in an amount as high as 11.82%. Typically, as water level is lower, less glycerine is used.

Again, the amount of glycerol is plus or minus 15% of measured amount based on the formula, more preferably plus or minus 10%, furthermore preferably plus or minus 5% of the calculated amount.

In one form, the invention comprises 20 to 40% water; 20 to 75% anhydrous soap with levels of defined $C_8$ to $C_{14}$, unsaturated $C_{18}$, and $C_{16}$ to $C_{24}$ as noted; 0.05 to 35% structurants; a combination of alkali metal chloride and citrate and/or sulfate as secondary electrolyte; and glycerol at level defined by formula above.

Finishing Adjuvant Materials:

These are ingredients that improve the aesthetic qualities of the bar especially the visual, tactile and olfactory properties either directly (perfume) or indirectly (preservatives). A wide variety of optional ingredients can be incorporated in the bar composition of the invention. Examples of adjuvants include but are not limited to: perfumes; opacifying agents such as fatty alcohols, ethoxylated fatty acids, solid esters, and $TiO_2$; dyes and pigments; pearlizing agent such as $TiO_2$ coated micas and other interference pigments; plate like mirror particles such as organic glitters; sensates such as menthol and ginger; preservatives such as dimethyloldimethylhydantoin (Glydant XL1000), parabens, sorbic acid and the like; anti-oxidants such as, for example, butylated hydroxytoluene (BHT); chelating agents such as salts of ethylene diamine tetra acetic acid (EDTA) and trisodium etidronate; emulsion stabilizers; auxiliary thickeners; buffering agents; and mixtures thereof.

The level of pearlizing agent can be between about 0.1% to about 3%, preferably between 0.1% and 0.5% and most preferably between about 0.2 to about 0.4% based on the total weight of the bar composition.

Skin Benefit Agents:

Another class of optional ingredients which may be used are skin benefit agents; these are included to promote skin and hair health and condition. Potential benefit agents include but are not limited to: lipids such as cholesterol, ceramides, and pseudoceramides; antimicrobial agents such as hereinbelow detailed; sunscreens such as cinnamates; other types of exfoliant particles such as polyethylene beads, walnut shells, apricot seeds, flower petals and seeds, and inorganics such as silica, and pumice; additional emollients (skin softening agents) such as long chain alcohols and waxes like lanolin; additional moisturizers; skin-toning agents; skin nutrients such as vitamins like Vitamin C, D and E and essential oils like bergamot, citrus unshiu, calamus, and the like; water soluble or insoluble extracts of avocado, grape, grape seed, myrrh, cucumber, watercress, calendula, elder flower, geranium, linden blossom, amaranth, seaweed, gingko, ginseng, carrot; impatiens balsamina, camu camu, alpina leaf and other plant extracts such as witch-hazel, and mixtures thereof.

The composition of the invention could be used to deliver antimicrobial benefits. Antimicrobial agents that are preferably included to deliver this benefits include oligodynamic metals or compounds thereof. Preferred metals are silver, copper, zinc, gold or aluminium. Silver is particularly preferred. In the ionic form it may exist as a salt or any compound in any applicable oxidation state. Preferred silver compounds are silver oxide, silver nitrate, silver acetate, silver sulfate, silver benzoate, silver salicylate, silver carbonate, silver citrate or silver phosphate, with silver oxide, silver sulfate and silver citrate being of particular interest in one or more embodiments. In at least one preferred embodiment the silver compound is silver oxide. Oligodynamic metal or a compound thereof is preferably included in 0.0001 to 2%, preferably 0.001 to 1% by weight of the composition. Alternately an essential oil antimicrobial active may be included in the composition of the invention. Preferred essential oil actives which may be included are terpineol, thymol, carvacol, (E)-2(prop-1-enyl) phenol, 2-propylphenol, 4-pentylphenol, 4-sec-butylphenol, 2-benzyl phenol, eugenol or combinations thereof. Furthermore preferred essential oil actives are terpineol, thymol, carvacrol or thymol, most preferred being terpineol or thymol and ideally a combination of the two.

Essential oil actives are preferably included in 0.001 to 1%, preferably 0.01 to 0.5% by weight of the composition.

The composition can also include a variety of other active ingredients that provide additional skin (including scalp) benefits. Examples include anti-acne agents such as salicylic and resorcinol; sulfur-containing D and L amino acids and their derivatives and salts, particularly their N-acetyl derivatives; anti-wrinkle, anti-skin atrophy and skin-repair actives such as vitamins (e.g., A, E and K), vitamin alkyl esters, minerals, magnesium, calcium, copper, zinc and other metallic components; retinoic acid and esters and derivatives such as retinal and retinol, vitamin B3 compounds, alpha hydroxy acids, beta hydroxy acids, e.g. salicylic acid and derivatives thereof; skin soothing agents such as aloe vera, jojoba oil, propionic and acetic acid derivatives, fenamic acid derivatives; artificial tanning agents such as dihydroxyacetone; tyrosine; tyrosine esters such as ethyl tyrosinate and glucose tyrosinate; skin lightening agents such as aloe extract and niacinamide, alpha-glyceryl-L-ascorbic acid, aminotyroxine, ammonium lactate, glycolic acid, hydroquinone, 4 hydroxyanisole, sebum stimulation agents such as bryonolic acid, dehydroepiandrosterone (DHEA) and orizano; sebum inhibitors such as aluminum hydroxy chloride, corticosteroids, dehydroacetic acid and its salts, dichlorophenyl imidazoldioxolan (available from Elubiol); anti-oxidant effects, protease inhibition; skin tightening agents such as terpolymers of vinylpyrrolidone, (meth)acrylic acid and a hydrophobic monomer comprised of long chain alkyl (meth) acrylates; anti-itch agents such as hydrocortisone, methdilizine and trimeprazine hair growth inhibition; 5-alpha reductase inhibitors; agents that enhance desquamation; anti-glycation agents; anti-dandruf agents such as zinc pyridinethione; hair growth promoters such as finasteride, minoxidil, vitamin D analogues and retinoic acid and mixtures thereof.

Referring to structurants (0.05 to 35% structurants) discussed above, preferably are included starch, modified starch, acrylates and cellulose ethers.

Acrylates

It is preferred that the compositions of the invention comprise polymers. Polymers of the acrylate class are especially preferred. Preferred bars include 0.05 to 5% acrylates. More preferred bars include 0.1 to 3% acrylates. Examples of acrylate polymers include polymers and copolymers of acrylic acid crosslinked with polyallylsucrose as described in U.S. Pat. No. 2,798,053 which is herein incorporated by reference. Other examples include polyacrylates, acrylate copolymers or alkali swellable emulsion acrylate copolymers, hydrophobically modified alkali swellable copolymers, and crosslinked homopolymers of acrylic acid. Examples of such commercially available polymers are: ACULYN®, CARBOPOL®, and CARBOPOL® Ultrez grade series.

Cellulose Ethers

Preferred bars include 0.1 to 5% cellulose ethers. More preferred bars include 0.1 to 3% cellulose ethers. Preferred cellulose ethers are selected from alkyl celluloses, hydroxyalkyl celluloses and carboxyalkyl celluloses. More preferred bars include hydroxyalkyl celluloses or carboxyalkyl celluloses and particularly preferred bars include carboxyalkyl cellulose.

Preferred hydroxyalkyl cellulose includes hydroxymethyl cellulose, hydroxyethyl cellulose, hydroxypropyl cellulose and ethyl hydroxyethyl cellulose.

Preferred carboxyalkyl cellulose includes carboxymethyl cellulose. It is particularly preferred that the carboxymethyl cellulose is in form of sodium salt of carboxymethyl cellulose.

Optional Wax and Polyalkyleneglycols

Preferred wax includes paraffin wax and microcrystalline wax. When polyalkyleneglycols are used, preferred bars may include 0.01 to 5 wt. % Polyalkyleneglycols, more preferably 0.03 to 3 wt. % and most preferably 0.5 to 1 wt. %. Suitable examples include polyethyleneglycol and polypropyleneglycol. A preferred commercial product is POLYOX® sold by The Dow Chemical Company.

The invention will now be illustrated with the help of the following non-limiting examples.

EXAMPLES

General Understanding by Inventors that Different Electrolytes Produce Different Effects.

It is known generally that electrolytes in soap can harden soft bars and reduce stickiness caused, for example, by high levels of free fatty or emollients; or, as is the concern of our invention, high levels of water. The electrolyte can precipitate soluble soaps, thereby increasing "bricks" fraction and reducing "mortar" fraction. As noted, use of electrolyte typically leads to excessive cracking upon extrusion and/or efflorescence. However, we have found that different electrolytes have different effect on the soluble soaps in the mortar fraction.

Applicants prepared two examples of soap mortar with 5.3% by wt. NaCl or 5.3% by wt. sodium citrate to be analysed using nuclear magnetic resonance (NMR). This concentration of electrolyte in mortar corresponds to about 2.5% electrolyte in a bar with 25% water.

Applicants made two observations. First, addition of the NaCl to the mortar phase led to formation of 15% solid ("bricks"); 85% remained in the mortar phase. By contrast, addition of sodium citrate led to no soap precipitation (no brick formation). Thus, clearly, not all electrolytes work in the same way. Further, use of the citrate induced transition from hexagonal phase to lamellar gel phase that is not sticky. Applicants' understanding of the differing effects of different electrolytes is what led to a finding of using specific combinations of electrolyte to form solid while avoiding excessive cracking (as well as efflorescence).

There is no teaching or suggestion in the art that this problem could even be addressed by electrolyte combinations, let alone what specific ones would work.

Protocols

For measuring Hardness

Principle

A 30° conical probe penetrates into a soap/syndet sample at a specified speed to a pre-determined depth. The resistance generated at the specific depth is recorded. There is no size or weight requirement of the tested sample except that the bar/billet be bigger than the penetration of the cone (15 mm) and have enough area. The recorded resistance number is also related to the yield stress and the stress can be calculated as noted below. The hardness (and/or calculated yield stress) can be measured by a variety of different penetrometer methods. In this invention, as noted above, we use probe which penetrates to depth of 15 mm.

Apparatus and Equipment

TA-XT Express (Stable Micro Systems)

30° conical probe Part #P/30c (Stable Micro Systems)

Sampling Technique

This test can be applied to billets from a plodder, finished bars, or small pieces of soap/syndet (noodles, pellets, or bits). In the case of billets, pieces of a suitable size (9 cm) for the TA-XT can be cut out from a larger sample. In the case of pellets or bits which are too small to be mounted in the TA-XT, the compression fixture is used to form several noodles into a single pastille large enough to be tested.

Procedure

Setting up the TA-XT Express

These settings need to be inserted in the system only once. They are saved and loaded whenever the instrument is turned on again. This ensures settings are constant and that all experimental results are readily reproducible.

Set test method

Press MENU

Select TEST SETTINGS (Press 1)

Select TEST TPE (Press 1)

Choose option 1 (CYCLE TEST) and press OK

Press MENU

Select TEST SETTINGS (Press 1)

Select PARAMETERS (Press 2)

Select PRE TEST SPEED (Press 1)

Type 2 (mm $s^{-1}$) and press OK

Select TRIGGER FORCE (Press 2)

Type 5 (g) and Press OK

Select TEST SPEED (Press 3)
Type 1 (mm $s^{-1}$) and press OK
Select RETURN SPEED (Press 4)
Type 10 (mm $s^{-1}$) and press OK
Select DISTANCE (Press 5)
Type 15 (mm) for soap billets or 3 (mm) for soap pastilles and press OK
Select TIME (Press 6)
Type 1 (CYCLE)
Calibration
Screw the probe onto the probe carrier.
Press MENU
Select OPTIONS (Press 3)
Select CALIBRATE FORCE (Press 1) the instrument asks for the user to check whether the calibration platform is clear
Press OK to continue and wait until the instrument is ready.
Place the 2 kg calibration weight onto the calibration platform and press OK
Wait until the message "calibration completed" is displayed and remove the weight from the platform.
Sample Measurements
Place the billet onto the test platform.
Place the probe close to the surface of the billet (without touching it) by pressing the UP or DOWN arrows.
Press RUN
Take the readings (g or kg) at the target distance (Fin).
After the run is performed, the probe returns to its original position.
Remove the sample from the platform and record its temperature.
Calculation & Expression of Results
Output The output from this test is the readout of the TA-XT as "force" ($R_T$) in g or kg at the target penetration distance, combined with the sample temperature measurement. (In the subject invention, the force is measured in Kg at 40° C. at 15 mm distance) The force reading can be converted to extensional stress, according to the equation below:

The equation to convert the TX-XT readout to extensional stress is:

$$\sigma = \frac{1}{C}\frac{R_T g_c}{A}$$

where: σ=extensional stress
C="constraint factor" (1.5 for 30° cone)
$G_c$=acceleration of gravity
A=projected area of cone=$\pi(d \tan \frac{1}{2}\theta)^2$
d=penetration depth
θ=cone angle For a 30° cone at 15 mm penetration Equation 2 becomes $$\sigma(\text{Pa}) = R_T(g) \times 128.8$$

This stress is equivalent to the static yield stress as measured by penetrometer.

The extension rate is $$\dot{\varepsilon} = \frac{V}{d \tan\left(\frac{1}{2}\theta\right)}$$

where $\dot{\varepsilon}$=extension rate ($s^{-1}$)
V=cone velocity
For a 30° cone moving at 1 mm/s, $\dot{\varepsilon}$=0.249 $s^{-1}$ Temperature Correction The hardness (yield stress) of skin cleansing bar formulations is temperature-sensitive. For meaningful comparisons, the reading at the target distance ($R_T$) should be corrected to a standard reference temperature (normally 40° C.), according to the following equation:

$$R_{40} = R_T \times \exp[\alpha(T-40)]$$

where $R_{40}$=reading at the reference temperature (40° C.)
$R_T$=reading at the temperature T
α=coefficient for temperature correction
T=temperature at which the sample was analyzed.

The correction can be applied to the extensional stress.

Raw and Processed Data

The final result is the temperature-corrected force or stress, but it is advisable to record the instrument reading and the sample temperature also.

A hardness value of at least 1.2 Kg (measured at 40° C.) is acceptable. It should be understood there is a relationship between the ratio of soap/water and glycerin on the one hand and hardness on the other hand. When bars have less water (more soap and higher ratio), they are harder (further above the 1.2 Kg minimum required by the invention), but the advantage of extruding with less water is not as great. When the ratio is lower (closer to 1:1), this implies more water but bars are not as hard. In this regard, preferred hardness levels may be 1.2 to 2.0 Kg. This is consistent with preferred ratios of 1:1 to 2:1.

For Measuring Cracking:

Definitions:

Cracking can be defined as the physical damage which may result (or not) from the sequence of washdown and drying of the bar, as per the protocol bellow.

Principle:

Soap tablets are washed down in a controlled manner, 6 times per day for 4 days. The tablets are stored in controlled conditions after each washdown, and the weight loss is determined after a further 2 or 3 days drying out. Visual cracking assessments is made after 3 days of drying out under ambient conditions.

Apparatus and Equipment:

Soap trays, with drainers—preferably rigid plastic
1 sample per condition
Soap trays, without drainers—preferably rigid plastic
area of approximately 15×10 cm
flat bottom
1 sample per batch
Washing bowl—10 liter capacity (approx.)
Gloves—waterproof, disposable gloves (plastic or rubber)

Procedure:

Start the test on first morning (e.g., a Monday).

Weigh 4 tablets of each of the batches to be tested and put them on soap trays that have been coded as follows:

| Drainers? | Wash temperature (° C.) |
|---|---|
| Yes | 25 |
| Yes | 40 |
| No | 25 |
| No | 40 |

Measure 10 mL of water (room temperature and appropriate hardness) and pour into the tray without drainers (25° and 40° C.).

Carry out washdowns on each tablet of soap as follows:

a) Fill washing bowl with about 5 liters of water with appropriate hardness, and at the desired temperature (25° C. or 40° C.).
b) Mark the tablet to identify top face (e.g. make small hole with a needle).
c) Wearing waterproof gloves, immerse the tablet in the water, and twist 15 times (180° each time) in the hands above water.
d) Repeat (c).
e) Immerse the tablet in the water again in order to wash off the lather.
f) Place the tablet back on its soap tray, ensuring that the opposite face is uppermost (i.e. the unmarked face).

Carry out the full washdown procedure 6 times per day for 4 consecutive days, at evenly spaced intervals during each day (e.g. hours in day: 8.00, 09:30, 11.00, 12.30, 14.00, and 15.30. Alternate the face placed down after each washdown.

Between washdowns the soap trays should be left on an open bench or draining board, at controlled room conditions. (See Note 14.1.iii) After each washdown cycle, change the position of each soap tray/tablet on the bench, to minimize variability in drying conditions.

At the end of each day:

rinse and dry each soap tray with drainer drain and refill the soap tray without drainer (25° C. and 40° C.) with 10 mL water (ambient temperature). Consider the appropriate water hardness.

After the last wash down (afternoon of fourth day, e.g., Thursday), rinse and dry all soap trays, and place each tablet on its soap tray. On 5th day afternoon, turn the samples so they can dry both sides. On the eighth day (e.g., following Monday), weigh each tablet Cracking The visual assessment of the degree of cracking is carried out with the same samples used in the rate of wear test. Some cracking may occur during the first 5 days of the test, but for maximum level can be only observed after the final length of the test (i.e. on the 8th or 9th day).

Expression of Results:

A trained assessor examines the tablets and records separately the degree of cracking in each of the following areas:

Both faces—all types of tablets

Both ends—band-type tablets

Both sides—band-type tablets

Periphery—capacity die tablets

The degree of cracking is graded using the following 0-5 scale:

0—No cracking

1—Small and shallow cracking:

1.1—minimum degree 1.2—maximum degree

2—Small and medium deep cracking:

2.1—minimum degree 2.2—maximum degree

3—Medium and deep cracking:

3.1—minimum degree 3.2—maximum degree

4—Big and deep cracking:

4.1—minimum degree 4.2—maximum degree

5—Very big and very deep cracking:

5.1—minimum degree 5.2—maximum degree

Cracking scores of 3 and below are acceptable while 4 and 5 are not.

Stickiness of the Bar Protocol:

Place the bar in one hand palm face up; close and open fingers 3 times. Assess the product by tactile feel, accordingly to scale:

1—Not Sticky

2—Slightly Sticky

3—Moderately Sticky

4—Sticky

5—Very Sticky

Assessment scale is anchored on references presented to evaluator through videos and marketed products.

Acceptable stickiness grade is maximum 2.

Examples 1-5 and Comparatives A-E

Applicants set forth Examples 1-5 and Comparatives A-E below:

TABLE 2

| | Examples | | | | | | Comparatives | | | | |
|---|---|---|---|---|---|---|---|---|---|---|---|
| Ingredients | Ex. 1 | Ex. 2 | Ex. 3.1 | Ex. 3.2 | Ex. 4 | Ex. 5 | Comp A | Comp B | Comp C | Comp D | Comp E |
| Anhydrous Sodium Soap | 69.95 | 64.14 | 61.18 | 61.18 | 57.82 | 52.21 | 70.8 | 66.2 | 60.3 | 60.2 | 53.0 |
| Water | 20 | 25 | 27 | 27 | 30 | 35 | 20 | 25 | 27 | 30 | 35 |
| Glycerin | 6.3 | 5.6 | 5.6 | 5.6 | 5.2 | 4.7 | 6.4 | 5.8 | 5.4 | 5.3 | 4.7 |
| Sodium Chloride (Primary Electrolyte) | 0.87 | 1.25 | 1.40 | 1.40 | 1.62 | 2.00 | 0.8 | 0.7 | 2.0 | 0.7 | 4 |
| Sodium Citrate (Secondary Electrolyte) | 0.98 | 2.02 | 2.41 | — | 2.95 | 3.76 | 0.2 | 0.5 | 3.0 | 1.5 | 1 |
| Sodium Sulfate (Secondary Electrolyte) | — | — | — | 2.41 | — | — | — | — | — | — | — |
| Sodium carboxymethyl-cellulose (SCMC); binder, anticracking agent | 0 | 0 | 0.5 | 0.5 | 0.5 | 0.5 | 0 | 0 | 0.5 | 0.5 | 0.5 |

TABLE 2-continued

| | Examples | | | | | | Comparatives | | | | |
|---|---|---|---|---|---|---|---|---|---|---|---|
| Ingredients | Ex. 1 | Ex. 2 | Ex. 3.1 | Ex. 3.2 | Ex. 4 | Ex. 5 | Comp A | Comp B | Comp C | Comp D | Comp E |
| Minor Ingredients (Colorants, Perfume, Preservatives etc) | 1.9 | 1.9 | 1.8 | 1.8 | 1.8 | 1.8 | 1.8 | 1.8 | 1.8 | 1.8 | 1.8 |
| Hardness, kg @40° C. | 3.5 | 2.1 | 2.0 | 1.9 | 1.6 | 1.2 | 2.0 | 0.7 | 1.1 | 0.2 | 2.0 |
| Stickiness, score | 1 | 1 | 1 | 1 | 2 | 2 | 4 | 4 | 2 | 5 | 3 |
| Processability | vg | g | g | g | fair | ac | poor | poor | ac | poor | ac |
| Lather volume, mL | 280 | 293 | 285 | 282 | 289 | 294 | 292 | 286 | 291 | 288 | 294 |
| Rate of wear, % | 31 | 29 | 27 | 28 | 28 | 27 | 29 | 29 | 29 | 31 | 29 |
| Mush, g/cm$^2$ | 9.10 | 9.13 | 10.40 | 10.72 | 10.51 | 9.53 | 11.71 | 12.41 | 11.49 | 11.88 | 12.29 |
| Bar Cracking (Scale 0-5) | 2/1/0/0 | 3/0/0/0 | 1/3/3/3 | 1/3/2/3 | 3/2/0/0 | 3/3/0/0 | n/a | 3/0/0/0 | 5/4/4/4 | n/a | 4/4/5/5 |
| Issues/comment | | | | | | | Sticky | Soft/ Sticky | Crack | Soft/ sticky | Crack |
| Ratio soap/water + gly | 2.66 | 2.10 | 1.89 | 1.89 | 1.64 | 1.31 | 2.68 | 2.15 | 1.86 | 1.71 | 1.34 |

All of the Examples 1-5 have stickiness score of 2 or less and acceptable cracking scores below 4. Comparatives A, B, D and E have unacceptable stickiness scores of 3 or higher. Comparative C and E have unacceptable cracking scores of 4 and 5. Note: Examples 1 and 2 are outside the invention.

As seen above, when 20% water was used (Example 1 versus Comparative A), by using the formula for determining amount of NaCl (at 20% water level), we can calculate this equals use of 0.87% NaCl, i.e., amount needed for good extrusion while avoiding issues of cracking. Similarly, this calculates to use of 0.98% Na citrate. This results in a bar with good processing (no issues of stickiness) and low bar cracking.

By contrast, when arbitrarily choosing 0.8%, NaCl and 0.2% sodium citrate, the bar is sticky (stickiness score of 3 or more as for A, B, D and E) or has process problems (high cracking as in C and E).

There is no art which teaches or suggests that to use a process for selecting specific amounts of specific electrolytes will necessarily result in processable bars with no cracking issues (or efflorescence issue); nor is there disclosure of compositions/bars having this specific selection of electrolytes at specific levels. Example 3.1 and 3.2 show either sodium citrate or sodium sulfate can be secondary electrolyte.

Similar calculations are made when using 25%, 27%, 30% or 35% water (Examples 1 to 5) and, again, by randomly choosing different amounts of NaCl and Na citrates when same levels of water are used (Comparatives B-E), there is a good likelihood the bars will have processing or cracking problems. Nothing directs a person of ordinary skill on how to avoid this problem and, absent an understanding of the different effects of different electrolytes, there is no reason to select the specific types and amounts needed.

The invention claimed is:

1. An extruded soap bar composition, comprising:

a) 25 to 40% of water;

b) 20 to 75% by wt. anhydrous soap; wherein $C_{16}$ to $C_{24}$ saturated soap comprises 12% to 45% by wt. of total bar, c) structurants comprises at least from 0.05 to 35% by wt., wherein the specific level of structurants is defined by the level of $C_{16}$ to $C_{24}$ saturated soap of (b) such that the total level of said $C_{16}$ to $C_{24}$ saturated soap and structurants are greater than 25%, and wherein said structurants are selected from the group consisting of starch, carboxymethylcellulose, inorganic particulates, acrylate polymers and mixtures thereof;

d) electrolyte which is a combination of alkali metal chloride and a secondary electrolyte selected from the group consisting of alkali metal citrate and alkali metal sulfate; and wherein the concentration of alkali metal chloride ([alkali metal chloride]); and of alkali metal citrate ([alkali metal citrate]) or alkali metal sulfate ([alkali metal sulfate]) defined by level of water as follows:

i. [alkali metal chloride]%=0.075×[water]−0.626; and ii. [alkali metal citrate]%=−0.0023×[water]$^2$+0.312×[water]−4.34;

iii. [alkali metal sulfate] %=−0.0023×[water]$^2$+0.312×[water]−4.34; or iv. [alkali metal citrate or alkali metal sulfate or alkali metal citrate plus alkali metal sulfate]=−0.0023×[water]$^2$+0.312×[water]−4.34, wherein the calculated amount of the concentration of the electrolyte is plus or minus 15% by wt.

2. The extruded soap bar composition as claimed in claim 1, wherein the calculated amount of the concentration of the electrolyte is plus or minus 10% by wt.

3. The extruded soap bar composition according to claim 1, wherein the ratio of [soap] to [water], is 0.5:1 to 5:1.

4. The extruded soap bar composition according to claim 1, wherein the inorganic particulates are talc, calcium carbonate, zeolite or mixtures thereof.

5. The extruded soap bar composition according to claim 1, wherein the bar has a hardness value of 1.2 Kg to 5.0 Kg (measured at 40° C. with a 30° conical probe having a penetration depth of 15 millimeters.

6. The extruded soap bar composition according to claim 1, wherein the bar has a stickiness value less than 3 as measured by tactile feel test.

7. The extruded soap bar composition according to claim 1, wherein the bar has a cracking value of 3 or less as measured by visual assessment after at least 8 days.

8. The extruded soap bar composition of claim 3, wherein the ratio is 1:1 to 3:1.

9. The extruded soap bar composition of claim 8, wherein the ratio is 1:1 to 2:1.

10. The extruded soap bar composition of claim 3, further comprising water soluble solvent, wherein the ratio of [soap] to [water plus water soluble solvent] is 0.5:1 to 5:1.

* * * * *